US007581270B1

(12) United States Patent
Levesque

(10) Patent No.: US 7,581,270 B1
(45) Date of Patent: Sep. 1, 2009

(54) MATTRESS LIFTING DEVICE AND METHOD

(76) Inventor: Mary E. Levesque, 8 Mary Ann La., Wallingford, CT (US) 06492

( * ) Notice: Subject to any disclaimer, the term of this patent is extended or adjusted under 35 U.S.C. 154(b) by 0 days.

(21) Appl. No.: 11/775,934

(22) Filed: Jul. 11, 2007

(51) Int. Cl.
*A47C 31/00* (2006.01)

(52) U.S. Cl. ..... 5/660; 5/658; 5/659

(58) Field of Classification Search ..... 5/658–660, 5/488, 692, 509.1, 612
See application file for complete search history.

(56) References Cited

U.S. PATENT DOCUMENTS

| | | | | | |
|---|---|---|---|---|---|
| 992,080 | A | | 5/1911 | Swanger | |
| 1,599,000 | A | * | 9/1926 | Acuff | 5/660 |
| 1,630,453 | A | * | 5/1927 | Smith | 5/660 |
| 1,866,696 | A | * | 7/1932 | Birman | 5/612 |
| 2,381,509 | A | * | 8/1945 | Muenzen | 5/660 |
| 2,387,357 | A | | 10/1945 | Rogerson | |
| 2,390,660 | A | * | 12/1945 | Muenzen | 5/660 |
| 2,666,216 | A | * | 1/1954 | Schnaitter | 5/660 |
| 2,918,682 | A | * | 12/1959 | Thoresen et al. | 5/660 |
| 3,259,921 | A | | 7/1966 | Alsobrook, Jr. | |
| 3,353,196 | A | | 11/1967 | Guillon | |
| 3,581,321 | A | * | 6/1971 | Geary | 5/488 |
| 3,636,573 | A | | 1/1972 | Bartz | |
| 3,952,346 | A | | 4/1976 | Carlson | |
| 4,651,365 | A | * | 3/1987 | Zeigler | 5/660 |
| 4,703,526 | A | | 11/1987 | Degen | |
| 4,989,281 | A | * | 2/1991 | Christensen | 5/118 |
| 6,886,203 | B2 | | 5/2005 | Drakos et al. | |
| 2004/0133985 | A1 | * | 7/2004 | Drakos et al. | 5/658 |
| 2008/0222814 | A1 | * | 9/2008 | Jaeger | 5/658 |

* cited by examiner

*Primary Examiner*—Robert G Santos
(74) *Attorney, Agent, or Firm*—DeLio & Peterson, LLC; Peter W. Peterson; Thomas E. Ciesco

(57) ABSTRACT

A device for separating a mattress from a corresponding mattress support, the mattress lifting device comprising a stationary member, and a lifting member. The lifting member includes a lift plate adapted to slide in and out between the mattress and mattress support and a handle for moving the lift plate with respect to the stationary member. When a force is applied to the handle, the lift plate moves with respect to the stationary member and exerts a force sufficient to separate at least a portion of the mattress from the mattress support.

10 Claims, 7 Drawing Sheets

MATTRESS LIFTING DEVICE AND METHOD

BACKGROUND OF THE INVENTION

1. Field of the Invention

The present invention relates to a method and apparatus for lifting a portion of a mattress from a corresponding mattress support for individuals who have difficulty performing this task during periodic dressing of a bed.

2. Description of Related Art

For individuals who have limitations in strength and body movement, the task of lifting a mattress from a mattress support can be difficult if not impossible. Without having the mattress lifted while dressing the bed with sheets and a blanket, the dressings cannot be properly tucked into position, making for an improperly made bed.

There have been several devices which have been developed to reposition a mattress with respect to a mattress support so that a person lying on the mattress may have a section of their body elevated. This includes tilting the entire mattress so that it is evenly inclined, or raising a center or end portions of the mattress to help change blood circulation patterns in the lying persons body. However, these devices do not permit easy use to change or dress a bed, or portability and storage between uses. There has been a need for a device which does not have these limitations, especially for those individuals who do not want to feel dependent on another for tasks such as making a bed.

SUMMARY OF THE INVENTION

Bearing in mind the problems and deficiencies of the prior art, it is therefore an object of the present invention to provide an improved mattress lifting device and method which permits an individual with limited strength or movement to dress and change a bed.

It is another object of the present invention to provide a mattress lifting device which may be easily positioned to lift a mattress from a mattress support.

A further object of the invention is to provide a mattress lifting device which is portable and which may easily be stored between uses.

Still other objects and advantages of the invention will in part be obvious and will in part be apparent from the specification.

The above and other objects, which will be apparent to those skilled in the art, are achieved in the present invention which is directed to a device for separating a mattress from a corresponding mattress support, the mattress lifting device comprising a stationary member and a lifting member. The lifting member includes a lift plate adapted to slide in and out between the mattress and mattress support and a handle for moving the lift plate with respect to the stationary member. When a force is applied to the handle, the lift plate moves with respect to the stationary member and exerts a force sufficient to separate at least a portion of the mattress from the mattress support.

In one embodiment, the mattress lifting device of the present invention comprises a stationary member including a guide plate adapted to slide in and out between the mattress and mattress support. The guide plate may have a hollowed inset portion to accommodate the lift plate when the lift plate is in a retracted position The stationary member may include a back adapted to rest against a side or end of a mattress support when the lift plate has been inserted sufficiently far between the mattress and mattress support. The lifting member may be pivotally attached to the stationary member. The mattress lifting device of the present invention preferably includes a locking mechanism adapted to secure the lift plate in at least one position with respect to the stationary member. An end of the lift member opposite the handle may have rollers adapted to slide along a surface of the lift plate and may include a guide bar adapted to maintain the lift plate in a substantially horizontal orientation.

Alternatively, the stationary member may comprise a floor stand positioning the lift plate at a height above the floor corresponding to the lower surface of the mattress. The lifting member may be a hydraulic cylinder wherein the force on the handle is a pumping action for moving the lift plate with respect to the stationary member.

In another aspect, the present invention is directed to a method for separating a mattress from a corresponding mattress support thereunder. The method employs a device for separating a mattress from a corresponding mattress support comprising a stationary member including a guide plate adapted to slide in and out between the mattress and mattress support. The guide plate may have a hollowed inset portion to accommodate the lift plate when the lift plate is in a retracted position The stationary member may include a back adapted to rest against a side or end of a mattress support when the lift plate has been inserted sufficiently far between the mattress and mattress support. The lifting member may be pivotally attached to the stationary member. The mattress lifting device of the present invention preferably includes a locking mechanism adapted to secure the lift plate in at least one position with respect to the stationary member. The method includes sliding the lift plate between the mattress and a mattress support at a location where the mattress and mattress support are to be separated. A force is exerted on the handle sufficient to move the lifting member with respect to the stationary member thereby separating at least a portion of the mattress from the mattress support.

Preferably, the mattress lifting device has a stationary member with a guide plate adapted to slide in and out between the mattress and mattress support. The guide plate may have a hollowed inset portion to accommodate the lift plate when the lift plate is in a retracted position. The stationary member may include a back adapted to rest against a side or end of a mattress support when the lift plate has been inserted sufficiently far between the mattress and mattress support. The lifting member may be pivotally attached to the stationary member. The method may include the device having a locking mechanism adapted to secure the lift plate in at least one position with respect to the stationary member. The lift member opposite the handle may have rollers adapted to slide along a surface of the lift plate and may include a guide bar adapted to maintain the lift plate in a substantially horizontal orientation.

The stationary member may alternatively comprise a floor stand positioning the lift plate at a height above the floor corresponding to the lower surface of the mattress.

The lifting member may comprise a hydraulic cylinder wherein the force on the handle is a pumping action for moving the lift plate with respect to the stationary member.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-13 of the drawings in which like numerals refer to like features of the invention.

The present invention is a method and apparatus for lifting a portion of a mattress from its corresponding mattress support. Although the mattress support is usually a box spring, the invention may be used for any mattress support which has an upper surface corresponding to a lower surface of the mattress and supporting substantially the entire mattress. The mattress and mattress support have substantially similar lengths and widths, with the mattress sides extending along the mattress length and mattress ends extending across the mattress width, and the mattress support sides extending along the mattress support length and mattress support ends extending across the mattress support width. The mattress and mattress support end and side surfaces are substantially perpendicular to the upper and lower surfaces of the corresponding mattress and mattress support.

Figure 1:
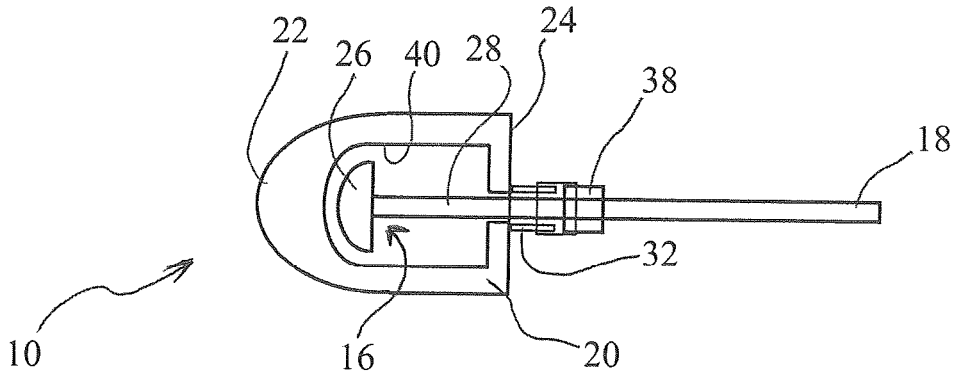
FIG. 1 is a top plan view of a first embodiment of the mattress lifter of the present invention.
Figure 2:
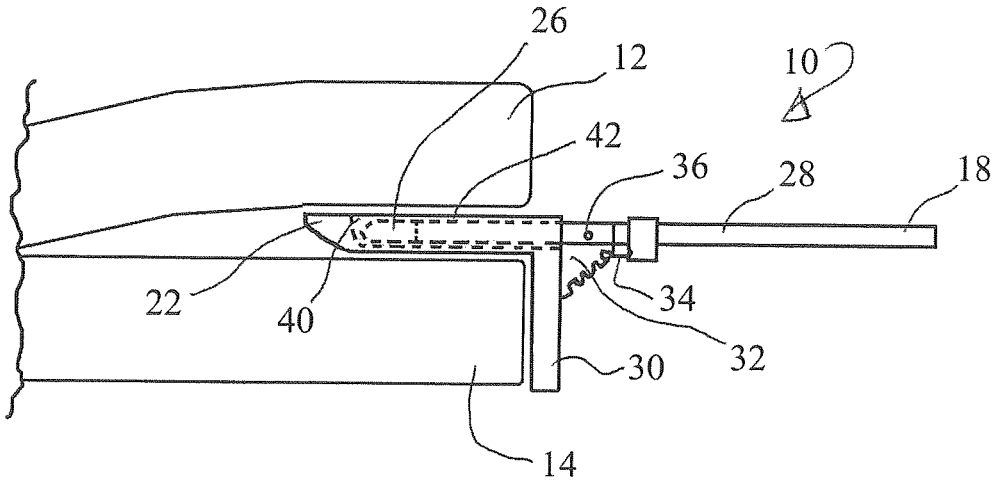
FIG. 2 is a side elevational view of the mattress lifter shown in FIG. 1, the lift plate in the retracted position.
Figure 3:
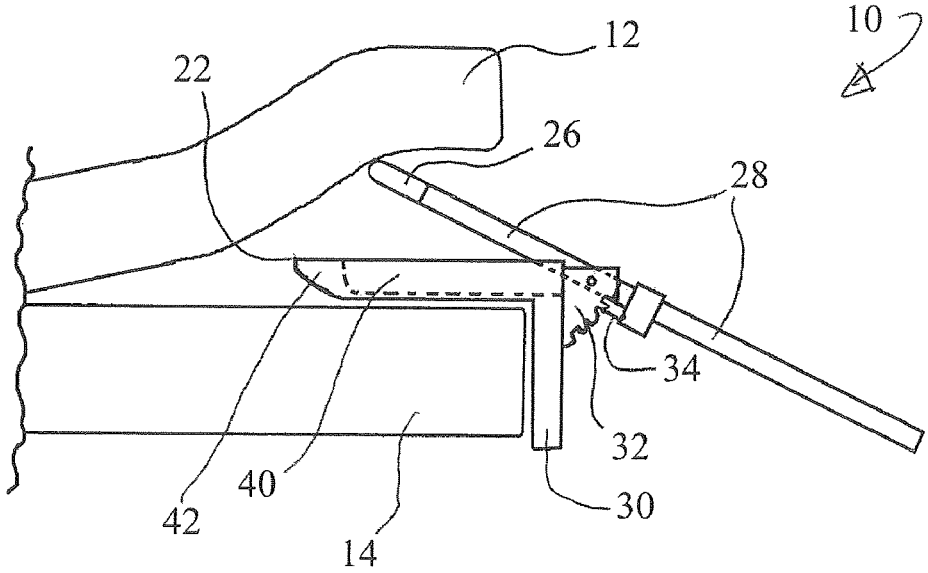
FIG. 3 is a side elevational view of the mattress lifter shown in FIG. 1, the lift plate in the lifting position.

A first embodiment of the present invention is shown in FIGS. 1-3. The mattress lifting apparatus 10 of the present invention includes a stationary member 20 with a flat guide plate or portion 42 and a back plate or portion 30 attached to the guide portion at approximately right angles along corresponding edges. The guide plate 42 has a tapered nose end 22 distal from the stationary member and an opposite heel end connected to the stationary member back 30. The stationary member guide plate 42 has a thickness sufficient to allow it to be slidable between the mattress 12 and the underlying mattress support 14, here shown as a conventional box spring. The stationary member back 30 functions as a stop indicating when the guide has been inserted sufficiently far between the mattress and mattress support, as the stationary member back 30 contacts a mattress support end or side.

The lifting member 16 shown in FIGS. 1-3 is an elongated component having a handle 18 at one end and a flat lift plate 26 attached opposite the handle. The lifting member 16 may be formed from any material which resists bending, preferably being a tube 28 with a cylindrical or rectangular cross section. The lifting member is pivotally attached to the stationary member such that when force is applied downward on the handle, an upward force is produced by the lift plate. When the lifting member 16 is in the retracted position, lifting member lift plate 26 is co planar with the stationary member guide plate 42, with the guide plate 42 having an inset portion 40 hollowed to accommodate the lift plate 26 and tube 28, and the lift plate 26 being configured to fit within the hollowed opening 40. The thickness of the guide plate 42 and retracted lift plate 26, and the taper of end 22, is sufficient to permit easy sliding insertion between mattress 12 and mattress support 14. The lifting member 16 is pivotally attached to the stationary member 42 by notched lock plates 32 attached substantially perpendicular along the stationary member 42 back and a pivot pin 36 through the tube and lock plates. A locking collar 38 is attached to the tube 28 near the lock plate 32, the locking collar having a lock bar 34 slidingly attached and a tension spring (not shown) urging the lock bar 34 toward the notches of the lock plate 32. Typically guide plate 42 is slid under mattress 12 along its side, where the bed is normally accessible by the user, rather than along the mattress end. In this embodiment of the invention, the lifting member tube 28 is perpendicular to the side of the mattress 12 and mattress support 14 when the lifting member is in the retracted position.

In operation, the mattress lifter embodiment of FIGS. 1-3 is adapted to be slid between the mattress 12 and mattress support 14 at any location along the sides or ends thereof. The lifting member 16 and lift plate 26 are initially in the retracted position, positioned in a co-planar position within the inset portion 40 of the guide plate 42, and the stationary member guide plate 42 is in a horizontal position with the stationary member back 30 below the plane of the guide plate 42. The lock bar 34 is seated within the top notches of the lock plate 32, securing the lifting member in the retracted position. Grasping the lifting member handle 18, the user then inserts the nose 22 of the guide plate 42 between the mattress 12 and mattress support 14 at a location along the ends or sides where the mattress portion is to be lifted, preferably along the mattress sides normally accessed by the user, and insertion is terminated by the contact of the stationary member back 30 with the end or the side of the mattress support 14 where the mattress lifter was inserted. FIG. 2 shows the mattress lifter after this insertion step has been completed, showing the front face of the back 30 in substantially full contact with the end or side of the mattress support 14.

The lock bar within collar 38 is then pulled by the user in a direction toward the handle 18, compressing the tension spring and releasing the lock bar 34 from the notch in the lock plate 32. The user then applies force to the handle 18 in a downward direction, thereby moving the lift plate 26 in an upward direction by pivoting movement around guide pin 36 relative to the still stationary guide plate 42. As the lift plate moves upward, the portion of mattress 12 at and near the location of insertion is lifted. The force on the handle 18 needed to lift the mattress 12 to the desired position is the holding force. The lock bar 34 is then released, causing the lock bar to snap into a lock plate 32 notch. FIG. 3 shows a portion of the mattress 12 lifted by the lift plate 26 and the lock bar 34 securing the lifting member 26 after this step has been completed. The user then performs the operation for which the mattress was raised, for example removing or inserting a mattress sheet. Subsequently, while exerting a force downward on the handle 18 substantially equal to the holding force, the user then pulls the lock bar 34 from the notches of the lock plates 32, and slowly releases the force applied to the handle until the lift plate 26 is lowered and retracted within the guide plate inset 40. The lock bar 34 is released by the user and the lock bar 34 snaps into the top notch of the lock plate. The user then removes the mattress lifter 10 by a sliding movement from between the mattress 12 and mattress support 24.

Figure 4:
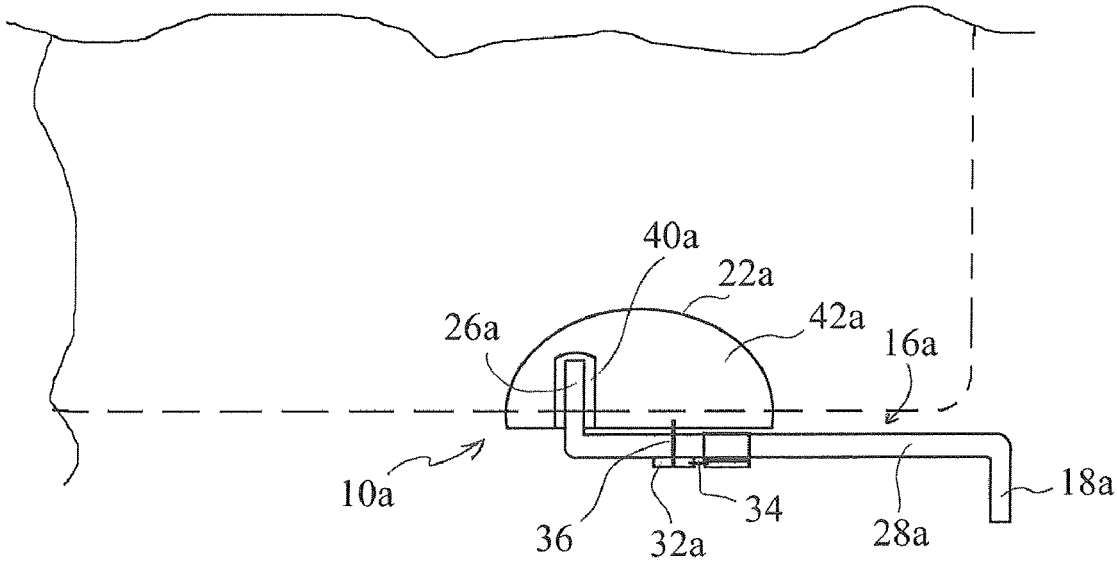
FIG. 4 is a top plan view of a second embodiment of the mattress lifter of the present invention.
Figure 5:
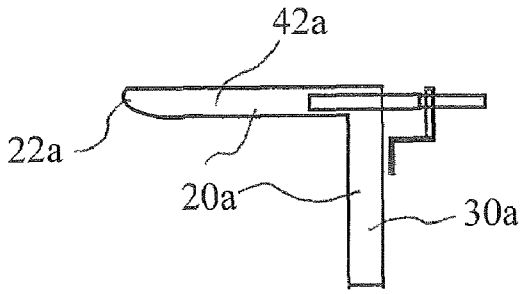
FIG. 5 is a side elevational view of the mattress lifter shown in FIG. 4
Figure 6:
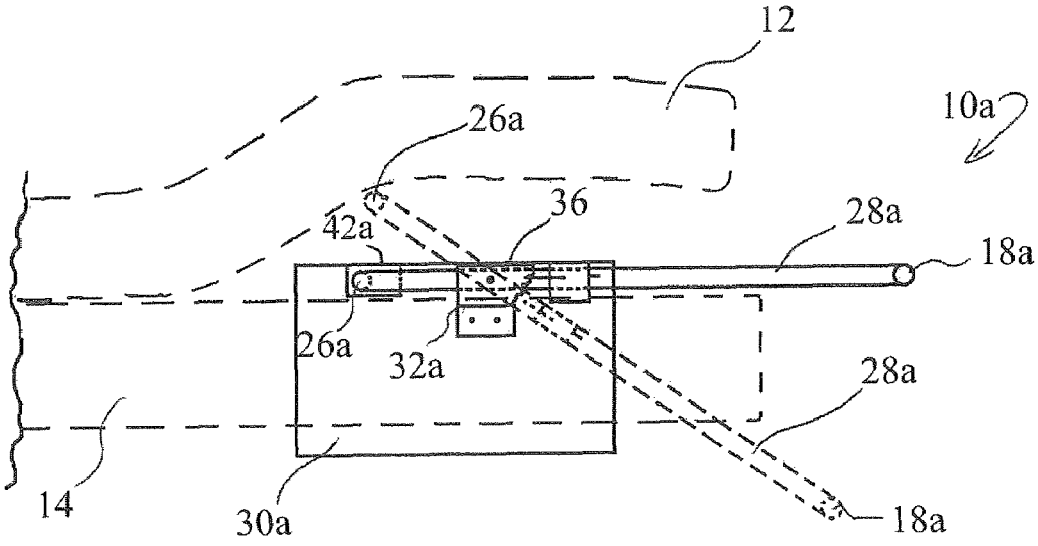
FIG. 6 is a front elevational view of the mattress lifter shown in FIG. 4, the lift plate in the retracted position and in phantom lines, the lift plate in the lifting position.

Another embodiment of the mattress lifter of the present invention shown in FIGS. 4-6, wherein the mattress lifter 10*a* includes a stationary member 20*a* with a flat guide plate or portion 42*a* and a back portion 30*a* attached to the guide portion 42*a* at approximately right angles along corresponding edges. The guide plate 42*a* has a tapered nose end 22*a* and an opposite heel end connected to the stationary member back 30*a*. The stationary member guide 42*a* has a thickness sufficient to allow it to be slidable between the mattress 12 and mattress support 14. The stationary member back 30 functions as a stop indicating the guide has been inserted far enough in, between the mattress 12 and mattress support 14, as the stationary member back contacts a mattress end or side. The lifting member is parallel to the side or end of the mattress when the lifting member is in the retracted position.

In the embodiment of FIGS. 4-6, the lift member is a tubular end portion 26*a* having a width smaller than the length, with the lift tube 26*a* length substantially perpendicular to the elongated tubular component of the lifting member 28*a*. The guide plate 42*a* has an inset portion 40*a* hollowed to accommodate the lift tube 26*a* when the lift tube 26*a* is in the retracted position. The lifting member 28*a* is pivotally attached to the stationary member 20*a* by notched lock plates 32*a* attached substantially parallel along the stationary member back 30*a* and a pivot pin 36 through the elongated component 28*a* and lock plates 32*a*. The locking plate 32*a* here parallel to the stationary member back is different than locking plate 32 in the first embodiment wherein the latter locking plates are perpendicular to the back. As shown in the inserted position in FIG. 4, the elongated tubular component 28*a* of the second embodiment is disposed in an orientation parallel to the mattress 12 and mattress support 14 side or end where the mattress portion is to be raised. A sliding locking collar 38 is attached over the tube 28*a* near the lock plate 32*a*, and has a lock bar 34 slidingly attached and a tension spring urging the lock bar 34 toward the notches of the lock plate 32*a*. Handle 18*a* is an end portion of tube 28*a* extending perpendicularly therefrom, away from mattress 12

FIG. 6 shows the mattress lifter 10*a* in the retracted position and, in phantom lines, the mattress lifter 10*a* and the mattress 12 in the raised position. In operation, the lift tube 26*a* is initially placed in the retracted position, positioned within the inset portion 40*a* of the guide plate 42*a*, and the stationary member guide plate 42*a* is in a horizontal position with the stationary member back 30*a* below the plane of the guide plate 42*a*. The lock bar 34 is seated within the top notches of the lock plate 32*a*, securing the lifting member 16*a* in the retracted position. The nose 22*a* of the guide plate 42*a* is then inserted in between the mattress 12 and mattress support 14 at a location along the ends or sides where the mattress portion is to be lifted, and insertion is terminated by the contact of the stationary member back 30*a* with the end or the side of the mattress support where the mattress lifter was inserted. The front face of the back 30*a* is in substantially full contact with the end or side of the mattress support 14 when the mattress lifter is in the fully inserted position.

The lock bar within collar 38 is pulled by the user in a direction toward the handle 18*a*, compressing the tension spring and releasing the lock bar 34 from the notch in the lock plate 32*a*. Force is then applied to the handle 18*a* in a downward direction moving the lift member 22*a* in an upward direction by pivoting movement around guide pin 36 relative to the stationary guide plate 42*a*. As the lift tube 22*a* moves upward, the mattress 12 portion at and near the location of insertion is lifted. The lock bar 34 is then released and snaps into a lock plate 32*a* notch as the force on the handle 18*a* is released. Then, when the mattress edge is to be lowered, the user exerts a force downward on the handle 18*a* about equal to the holding force, pulls the lock bar 34 from the notches of the lock plates 32*a*, and slowly releases the force applied to the handle until the lift tube 26*a* is retracted within the inset 40*a* of the guide plate 42*a*. The lock bar is released and snaps into the top notch of the lock plate 32*a*. The mattress lifter 10*a* is then removed by sliding it out from between the mattress 12 and mattress support 14. In this embodiment, the lifting member 28*a* in the retracted position is parallel to the side or end of the mattress to be raised, in contrast to the first embodiment where the lifting member 28 is perpendicular to the side or end of the mattress to be raised.

Figure 7:
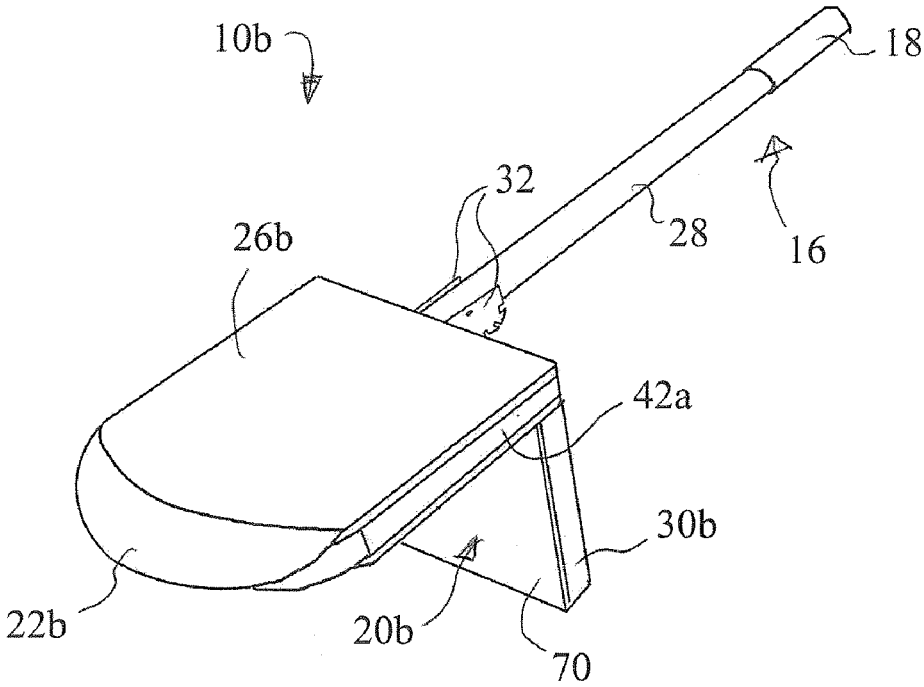
FIG. 7 is a perspective view of a third embodiment of the mattress lifter of the present invention.
Figure 8:
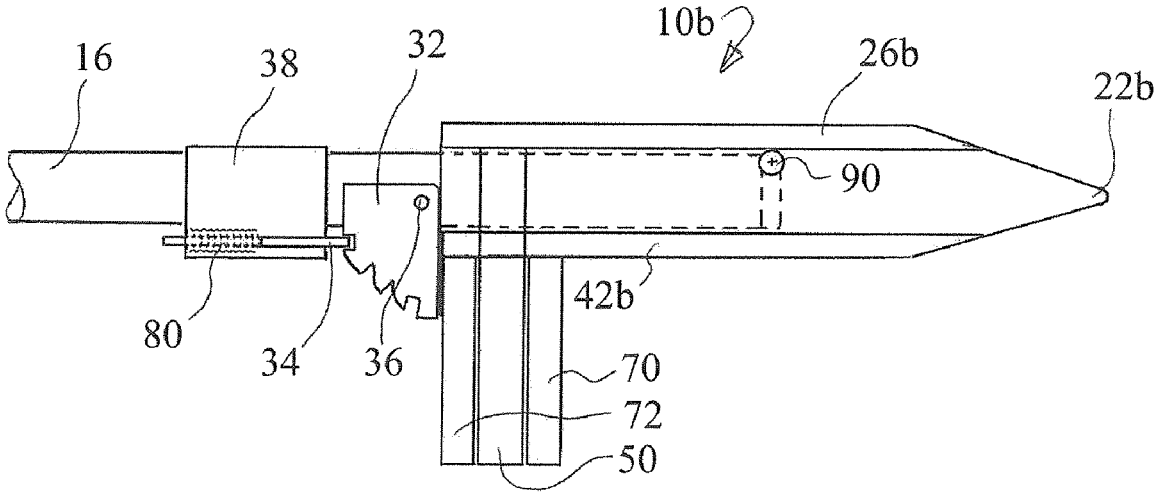
FIG. 8 is a side elevational view of the mattress lifter shown in FIG. 7, the lift plate in the retracted position.
Figure 9:
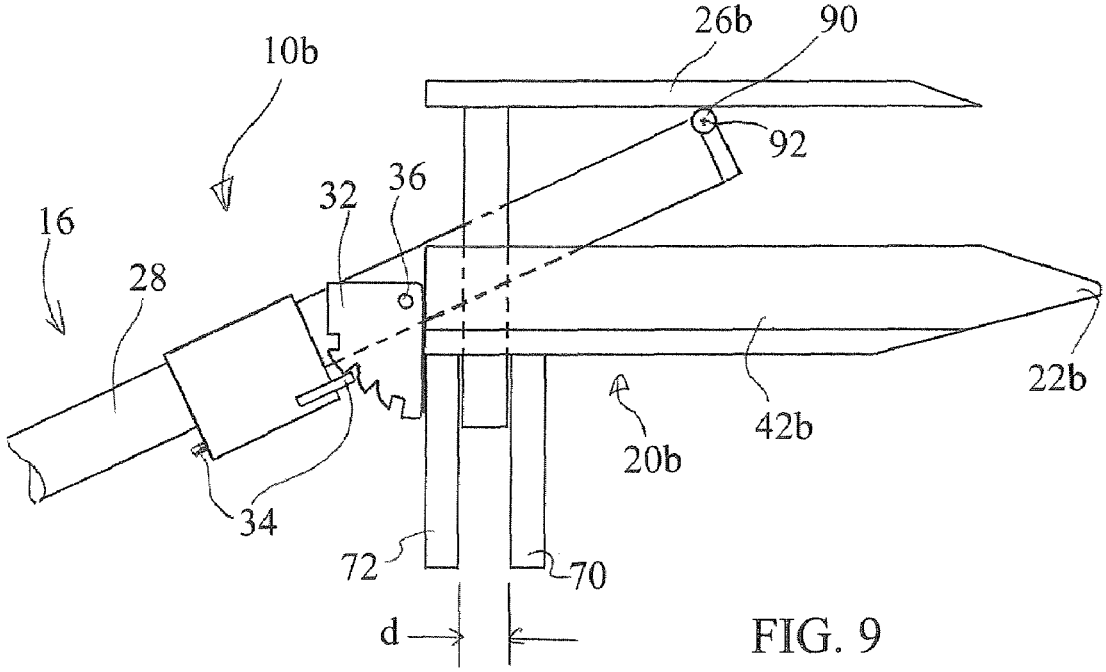
FIG. 9 is a side elevational view of the mattress lifter shown in FIG. 7, the lift plate in the lifting position.
Figure 10:
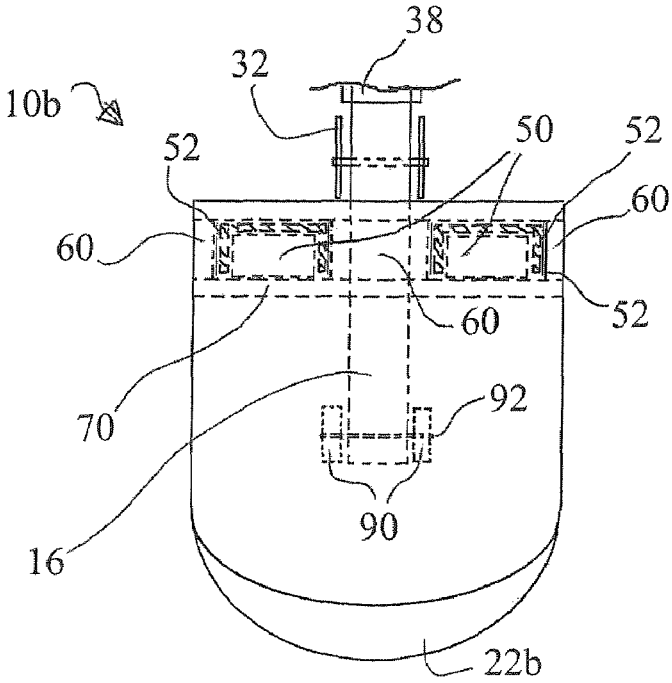
FIG. 10 is a top plan view of the mattress lifter shown in FIG. 7

A further embodiment of the present invention is shown in FIGS. 7-10. The stationary member 20*b* of mattress lifter 10*b* includes a flat guide portion 42*b* and a back portion 30*b* attached to the guide portion at approximately right angles along corresponding edges. Lift plate 26*b* is also flat and is disposed over and in contact with guide plate 42*b* when in the retracted position (FIGS. 7 and 8). The lift plate 26*b* and stationary member guide 42*b* have a combined thickness sufficiently thin to allow them to be slidable between the mattress and mattress support. In this embodiment, the stationary member back 30*b* has a front portion 70 parallel with a rear portion 72, and separated by a distance d. The space between the front and back portions 70, 72 accommodates a guide bar 50 attached substantially perpendicular to the guide plate 42*b*, with the guide bar 50 slidingly fitting between the front and rear portions 70, 72. Filler blocks 60 constrain the guide bar 50 from moving only in an upright orientation. Preferably, thin Teflon shims are placed along the filler blocks 60 and the front and rear portions 70, 72 where the guide bar slides. The lifting member 16 includes an elongated tubular component 28 with a handle 18 at one end.

The opposite end of the lifting member 16 has rollers 90 attached by a roller pin 92 so that the rollers are the only portions of the lifting member 16 contacting the lifting plate 26*b*. The lifting member tube 28 is pivotally attached to the stationary member 20*b* by notched lock plates 32 attached substantially perpendicular along the stationary member back 30*b* and a pivot pin 36 through the elongated tube 28 and lock plates 32. A locking collar 38 is attached to the elongated component near the lock plate 32, the locking collar 38 having a lock bar slidingly 34 attached and a tension spring 80 urging the lock bar 34 toward the notches of the lock plate 32.

In operation, the embodiment of the present invention presented in FIGS. 7-10 permits the lifting plate 26*b* to remain in the horizontal position while it is raised, by means of operation of rollers 90 on the lifting member 16 end and guide bar 50 supported in the vertical direction by the front and rear portions 70, 72 of the stationary member back 30*b*. Operation begins with the mattress lifter 10*b* in the retracted position, with the stationary member 20*b* guide plate 42*b* and lift plate 26*b* in contact in a horizontal position, and the stationary member back 30*b* below the plane of the guide plate 42*b*. The lock bar 34 is seated within the top notches of the lock plate 32, securing the lifting member 16 and lift plate 26*b* in the retracted position. The nose 22*b* of the guide plate 42*b* is then inserted in between the mattress and mattress support at a location along the ends or sides where the mattress portion is to be lifted, and insertion is terminated by substantially full contact of the front portion 70 of stationary member back 30*b* with the end or the side of the mattress support where the mattress lifter was inserted.

The lock bar 34 within locking collar 38 is pulled in a direction toward the handle 18, compressing the tension spring 80 and releasing the lock bar 34 from the notch in the lock plate. Force is then applied to the handle 18 in a downward direction, causing the roller 90 to exert a force on the underside of the lift plate 26*b*. The roller 90 urges the lift plate 26*b* upward, with the lift plate maintaining a horizontal orientation by virtue of the attached guide bar 50 constrained within the front and rear back portions 70, 72 and filler blocks 60. Lift plate 26*b* remains essentially parallel with respect to guide plate 42*b* throughout its movement. As the lift plate 26*b* moves upward, the mattress portion at and near the location of insertion is lifted. As before, the lock bar 34 is then released and snaps into a lock plate 32 notch as the force on the handle 18 is released. When the mattress needs to be lowered, the user again exerts a force downward on the handle 18 about equal to the holding force, pulls the lock bar 34 from the notches of the lock plates 32, and slowly releases the force applied to the handle 18 until the lift plate 26*b* is retracted to a position in contact with the top side of guide plate 42*b*. The lock bar 34 is released and snaps into the top notch of the lock plate 32. The mattress lifter 10*b* is then removed by sliding it out from between the mattress and mattress support.

Figure 11:
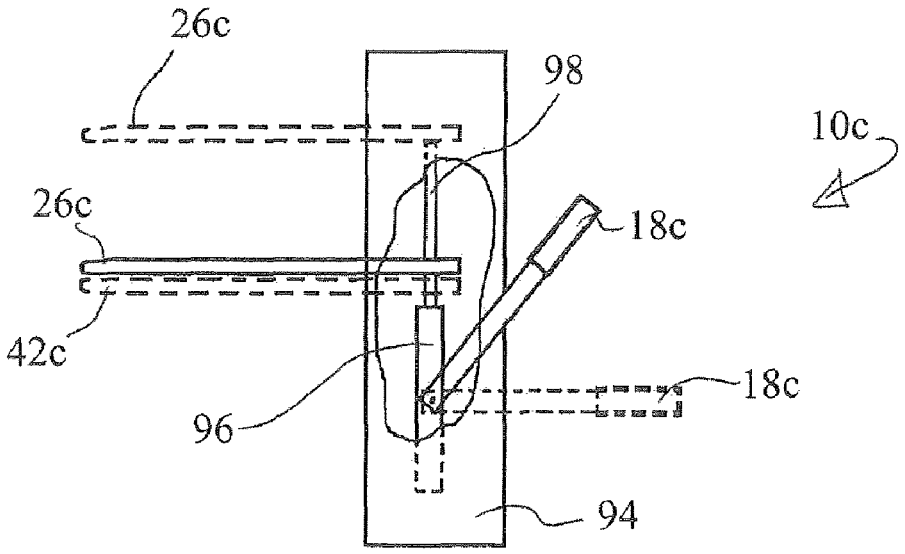
FIG. 11 is a side elevational view of a hydraulically assisted mattress lifter of the present invention.
Figure 12:
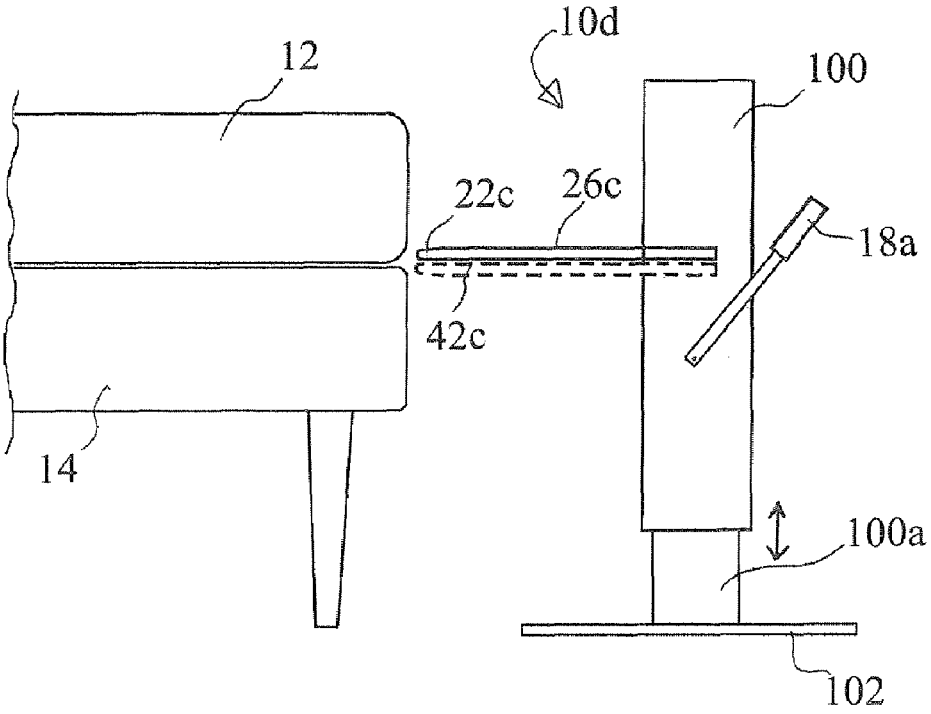
FIG. 12 is a side elevational view of a floor stand usable with the previous embodiments of the mattress lifter before it is inserted between the mattress and mattress support.
Figure 13:
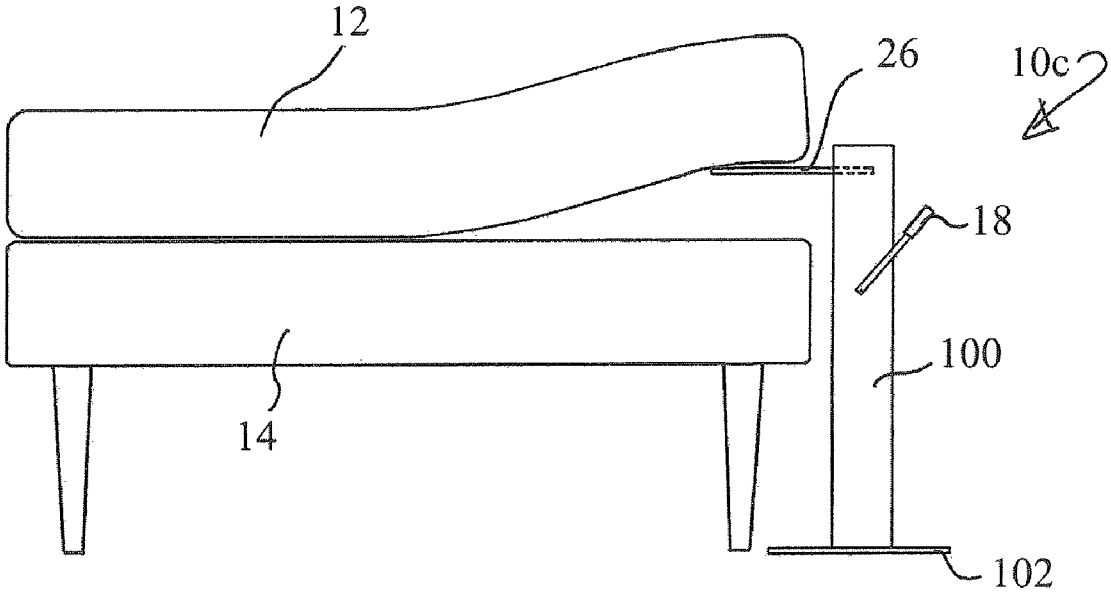
FIG. 13 is a side elevational view of the floor stand mattress lifter shown in FIG. 12 in the lifting position.

FIG. 11 shows a hydraulically assisted embodiment of the mattress lifter 10*c* of the present invention. The stationary member is a flat guide plate 42*c* attached to an enclosure 94 containing a hydraulic cylinder 96 and hydraulic rod 98. A flat lift plate 26*c* is disposed over and in contact with guide plate 42*c*. The hydraulic cylinder 96 is vertically positioned in the enclosure 94 such that when the hydraulic rod 98 is forced out of the cylinder by hydraulic pressure, the upper rod end moves in an upward direction, forcing the lift plate 26*c* to extend away from the guide plate 42*c*. A hydraulic handle 18*c* is used to pressurize hydraulic fluid, forcing the rod 98 to extend upward. The handle 18*c* may also be used to release hydraulic pressure from the rod 98, allowing the rod to retract.

In operation, the nose 22*c* of the stationary member guide plate 42*c* is inserted in between the mattress and mattress support at a location along the ends or sides where the mattress portion is to be lifted, and the guide plate 42*c* and adjacent lift plate 26*c* are slid inward. Insertion is terminated by the contact of the enclosure 94 with the end or the side of the mattress support where the mattress lifter was inserted. Force is then applied to the handle 18 with a pumping action, moving the lift plate 22*c* in an upward direction away from the stationary member 42*c* seated against the mattress support. Lift plate 26*c* remains essentially parallel with respect to guide plate 42*c* throughout its movement. As the lift plate 26*c* moves upward, the mattress portion at and near the location of insertion is lifted. After the mattress no longer needs to be raised, a hydraulic release (not shown) releases hydraulic pressure within the cylinder 96, allowing the hydraulic rod 98 to retract into the cylinder, and lowering the lift plate 26*c* to a position close to or in contact with the stationary member guide plate 42*c*. The mattress lifter 10*c* is then removed from between the mattress and mattress support.

Any of the mattress lifter embodiments discussed above may be modified to use a floor standing apparatus for lifting the mattress. Using the embodiment of FIG. 11 as an example, the mattress lifting device 10*d* shown in FIGS. 12-13 includes a base plate 102 attached at the bottom portion 100*a* of vertically extending body or housing 100. Top housing portion 100 is slideable with respect to bottom portion 100*a*, so as to hold the lift plate 26*c* at a fixed or adjustable distance from the base plate 102 sufficient to permit the lift plate 26*c* to be positioned at a height near the lower surface of the mattress when the lift plate 42*c* is in its retracted position. A stationary plate 42*c* may optionally be included in this embodiment of the invention, but is also at a fixed or adjustable location corresponding to the upper surface of the mattress support 14. The body 100 of the device 10*d* includes any of the mechanisms for raising the lift plate 22*c* in accordance with the embodiments previously described.

In operation, any of the embodiments modified to form a floor standing apparatus for lifting a mattress use the floor as a surface to apply an upward force to the lift plate. This is in contrast to the previous embodiments using contact of the stationary member guide plate with the mattress support to provide the base for upward movement of the lift plate. With the floor stand base feature of the present invention, a stationary member guide 42*c* is optional. The lifting plate 22*c* in the retracted position is level with the lower surface of the mattress 12. After insuring that it is positioned at the proper height, lifting plate 22*c* is inserted at a location along the ends or sides where the mattress portion is to be lifted, and insertion is terminated by the contact of the body 100 with the end or the side of the mattress support 14 where the mattress lifter was inserted. The base maintains contact with the floor during substantially the entire operation of the mattress lifter 10*d*. The lifting mechanism of any of the previous embodiments is activated to raise and lower the mattress using the lift plate. The lift plate is then removed from in between the mattress and mattress support by sliding the floor stand away from the bed.

Thus, the mattress lifter of the present invention permits a mattress to be easily raised and lowered from a mattress support, thereby permitting individuals with limited strength or mobility to make the bed or perform other required activities. Additionally, the present invention may be used by any individual, not just one having a disability, to facilitate making of the bed. The mattress lifter is portable, easily inserted into the side of the bed normally accessed by the individual, and may be easily stored away between uses.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for separating a mattress from a corresponding mattress support to dress a bed comprising:

providing a mattress having sides and ends along the perimeter thereof and a mattress support under the mattress, the mattress sides being normally accessible by the user;

providing a device for separating a mattress from a corresponding mattress support, the device comprising a stationary member and a lifting member, the lifting member including a lift plate adapted to slide in and out between the mattress and mattress support along the sides of the mattress and a handle for moving the lift plate, the lift member movable with respect to the stationary member such that when a downward force is applied to the handle, the lift plate moves with respect to the stationary member and exerts a force sufficient to separate at least a portion of the side of the mattress from the mattress support;

positioning the device along a side of the mattress normally accessible by the user;

using the handle to slide the lift plate between the mattress and a mattress support at the side of the mattress;

exerting a downward force on the handle sufficient to move the lifting member with respect to the stationary member, thereby separating at least a portion of the side of the mattress from the mattress support;

dressing the bed by removing or inserting a mattress sheet while the side of the mattress is separated from the mattress support; and releasing the handle until the side of the mattress contacts the mattress support; and using the handle, sliding the lift plate out from between the mattress and the mattress support.

2. The method of claim 1 wherein the stationary member is a guide plate adapted to slide in and out between the mattress and the mattress support.

3. The method of claim 1 wherein the stationary member is a floor stand and including initially positioning the lift member at a height above the floor corresponding to the lower surface of the mattress.

4. The method of claim 1 wherein the stationary member includes a back adapted to rest against a side or end of the mattress support when the lift plate has been inserted between the mattress and mattress support.

5. The method of claim 1 wherein the device includes a locking mechanism adapted to secure the lift plate in at least one position with respect to the stationary member and wherein after exerting force on the handle, the locking mechanism is initiated into a locked position, securing the lift plate in the lift position.

6. The method of claim 1 wherein the lifting member is a hydraulic cylinder and wherein the force on the handle is a pumping action for moving the lift plate with respect to the stationary member.

7. The method of claim 1 wherein the lifting member is pivotally attached to the stationary member.

8. The method of claim 1 wherein the guide plate has a hollowed inset portion to accommodate the lift plate when the lift plate is in a retracted position.

9. The method of claim 1 wherein an end of the lift member opposite the handle includes rollers adapted to slide along a surface of the lift plate.

10. The method of claim 9 wherein the lift plate includes a guide bar adapted to maintain the lift plate in a substantially horizontal orientation.

* * * * *